US006206591B1

(12) United States Patent
Kato

(10) Patent No.: US 6,206,591 B1
(45) Date of Patent: Mar. 27, 2001

(54) SHEET CARRYING DEVICE

(75) Inventor: Kazuhiro Kato, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/613,144

(22) Filed: Jul. 10, 2000

(30) Foreign Application Priority Data

Jul. 12, 1999 (JP) ..... 11-197841

(51) Int. Cl.[7] ..... B41J 11/58
(52) U.S. Cl. ..... 400/627; 400/629
(58) Field of Search ..... 400/627; 271/96, 271/276, 196

(56) References Cited

U.S. PATENT DOCUMENTS 3,827,548 * 8/1974 Matsuo ..... 198/184
4,589,652 * 5/1986 Silverberg ..... 271/245
5,967,510 * 10/1999 Ono et al. ..... 271/196

* cited by examiner

*Primary Examiner*—John S. Hilten
*Assistant Examiner*—Charles H. Nolan, Jr.
(74) *Attorney, Agent, or Firm*—Nath & Associates PLLC; Gary M. Nath

(57) ABSTRACT

According to the sheet carrying device of the present invention, the controlling unit changes the driving power of the fan driving source, depending on characteristics of the sheet. Therefore, appropriate sucking power can be caused to act, depending on the sort of the carried sheet.

11 Claims, 8 Drawing Sheets

FIG.4

| WEIGHT PER $M^2$ ($g/m^2$) | LARGER THAN A3 PAPER | A3~B4 PAPER | B4~A4 PAPER | A4~B5 PAPER | B5~A5 PAPER | A5~B6 PAPER | B6~A6 PAPER | SMALLER THAN A6 PAPER |
|---|---|---|---|---|---|---|---|---|
| 40 OR LESS | $A_{11}$ (V) | $A_{12}$ (V) | $A_{13}$ (V) | $A_{14}$ (V) | $A_{15}$ (V) | $A_{16}$ (V) | $A_{17}$ (V) | $A_{18}$ (V) |
| 41~60 | $A_{21}$ (V) | $A_{22}$ (V) | $A_{23}$ (V) | $A_{24}$ (V) | $A_{25}$ (V) | $A_{26}$ (V) | $A_{27}$ (V) | $A_{28}$ (V) |
| 61~80 | $A_{31}$ (V) | $A_{32}$ (V) | $A_{33}$ (V) | $A_{34}$ (V) | $A_{35}$ (V) | $A_{36}$ (V) | $A_{37}$ (V) | $A_{38}$ (V) |
| 81~100 | $A_{41}$ (V) | $A_{42}$ (V) | $A_{43}$ (V) | $A_{44}$ (V) | $A_{45}$ (V) | $A_{46}$ (V) | $A_{47}$ (V) | $A_{48}$ (V) |
| 101~120 | $A_{51}$ (V) | $A_{52}$ (V) | $A_{53}$ (V) | $A_{54}$ (V) | $A_{55}$ (V) | $A_{56}$ (V) | $A_{57}$ (V) | $A_{58}$ (V) |
| 121~140 | $A_{61}$ (V) | $A_{62}$ (V) | $A_{63}$ (V) | $A_{64}$ (V) | $A_{65}$ (V) | $A_{66}$ (V) | $A_{67}$ (V) | $A_{68}$ (V) |
| 141~160 | $A_{71}$ (V) | $A_{72}$ (V) | $A_{73}$ (V) | $A_{74}$ (V) | $A_{75}$ (V) | $A_{76}$ (V) | $A_{77}$ (V) | $A_{78}$ (V) |
| 161~180 | $A_{81}$ (V) | $A_{82}$ (V) | $A_{83}$ (V) | $A_{84}$ (V) | $A_{85}$ (V) | $A_{86}$ (V) | $A_{87}$ (V) | $A_{88}$ (V) |
| 180 OR MORE | $A_{91}$ (V) | $A_{92}$ (V) | $A_{93}$ (V) | $A_{94}$ (V) | $A_{95}$ (V) | $A_{96}$ (V) | $A_{97}$ (V) | $A_{98}$ (V) |

POSITION 1

POSITION 2

POSITION 3

SHEET CARRYING DEVICE

BACKGROUND OF THE INVENTION

1. Field of the Invention

The present invention relates to a sheet carrying device for carrying sheet on a carrying belt in the state that the sheet is caused to adhere to the carrying belt by sucking power of a suction fan.

2. Description of the Related Art

In a stencil printing machine, which is an image forming machine, it is necessary to feed paper in a paper feed section to a printing section and discharge the paper on which images have been printed in the printing section to a paper discharge section. For such paper-discharge, for example, a paper carrying device in a suction manner is used.

FIG. 1 illustrates an outline of a paper carrying device of this type. As shown in FIG. 1, pulleys 1 and 2 are located between a paper carrying start position and a paper carrying end position. An endless carrying belt 3 is set up onto this pair of the pulleys 1 and 2 to stretch therebetween. One of the pulleys 1 and 2 is driven and rotated by a belt driving motor 4. By the rotating power of the belt driving motor 4, the carrying belt 3 is moved. A great number of non-illustrated air permeating holes are made in the carrying belt 3. A suction fan 5 is positioned below the carrying belt 3. This suction fan 5 is made so as to suck air above the fan 5 by driving power of a motor 5*a* for the fan.

In the above-mentioned structure, the carrying belt 3 is moved by driving power of the belt driving motor 4, and the suction fan 5 is rotated by driving power of the motor 5*a* for the fan 5. When the paper 6 on which images have been printed is loaded from the paper carrying start position onto the carrying belt 3, the paper 6 is caused to adhere to the carrying belt 3 by sucking power of the suction fan 5 and the paper 6 in this adhesive state is carried to the paper carrying end position.

In the above-mentioned conventional paper carrying device, however, the sucking power of the suction fan 5 is constantly made a fixed value regardless of the size of the paper 6, the basis weight thereof and the like. Therefore, in the case that the carried paper 6 is so firm and heavy as cardboard or is small and thin, more sucking power than is required is acted. As a result, there arise such problems that excessive electric power is consumed and excessive load is applied to the carrying belt 3 by excessive sucking power.

SUMMARY OF THE INVENTION

The present invention has been achieved in the light of the above-mentioned situation and an object of the present invention is to provide a sheet carrying device making it possible to act appropriate sucking power, depending on the sort of sheet to be carried.

A primary feature of the present invention is a sheet carrying device comprising a carrying belt which is disposed in a sheet discharge section of an image forming machine and can move by driving power, a suction fan located below the carrying belt, and a fan driving source which supplies rotating power to the suction fan, sheet on the carrying belt being caused to adhere to the carrying belt by sucking power of the suction fan and carried, further comprising a sheet data detecting unit for detecting data on the carried sheet, and a controlling unit for controlling driving power of the fan driving source to make the sheet sucking power appropriate on the basis of the data on the carried sheet detected by means of the sheet data detecting unit.

According to this feature, the controlling unit makes the driving power of the fan driving source variable, depending on characteristics of the sheet.

The sheet carrying device may comprise a surrounding atmosphere data detecting unit for detecting surrounding atmosphere data, whereby the controlling unit controls the driving power of the fan driving source under additional consideration of the surrounding atmosphere data detected by means of the surrounding atmosphere data detecting unit.

According to this feature, the controlling unit makes the driving power of the fan driving source variable under additional consideration of the surrounding atmosphere data.

The sheet carrying device may comprise a carrying condition detecting unit for detecting carrying conditions of the carrying belt, whereby the controlling unit controls the driving power of the fan driving source under additional consideration of the carrying conditions detected by means of the carrying condition detecting unit.

According to this feature, the controlling unit makes the driving power of the fan driving source variable under additional consideration of the carrying conditions of the carrying belt.

The sheet data detecting unit is preferably composed of a sheet size detecting unit and a basis weight detecting unit.

According to this feature, the characteristics of the sheet are judged from the size and the basis weight of the sheet. On the basis of these data, the controlling unit makes the driving power of the fan driving source variable.

The surrounding atmosphere detecting unit is preferably a temperature/moisture detecting unit.

According to this feature, the surrounding atmosphere is judged from temperature and moisture. Under additional consideration of these data, the controlling unit makes the driving power of the fan driving source variable.

The carrying condition detecting unit is preferably a unit for detecting the state of a wing which the device has.

According to this feature, the carrying conditions are judged from the wing state. Under additional consideration of the data, the controlling unit makes the driving power of the fan driving source variable.

Here, basis weight means the weight per a unit area of a sheet such as a paper.

Other and further objects and features of the present invention will become obvious upon understanding of the illustrative embodiments about to be described in connection with the accompanying drawings or will be indicated in the appended claims, and various advantages not referred to herein will occur to one skilled in the art upon employing of the invention in practice.

BRIEF DESCRIPTION OF THE DRAWINGS

FIG. 4 is a view illustrating data contents in an applying-voltage table in the first embodiment of the present invention.

DETAILED DESCRIPTION OF THE PREFERRED EMBODIMENTS

Figure 1:
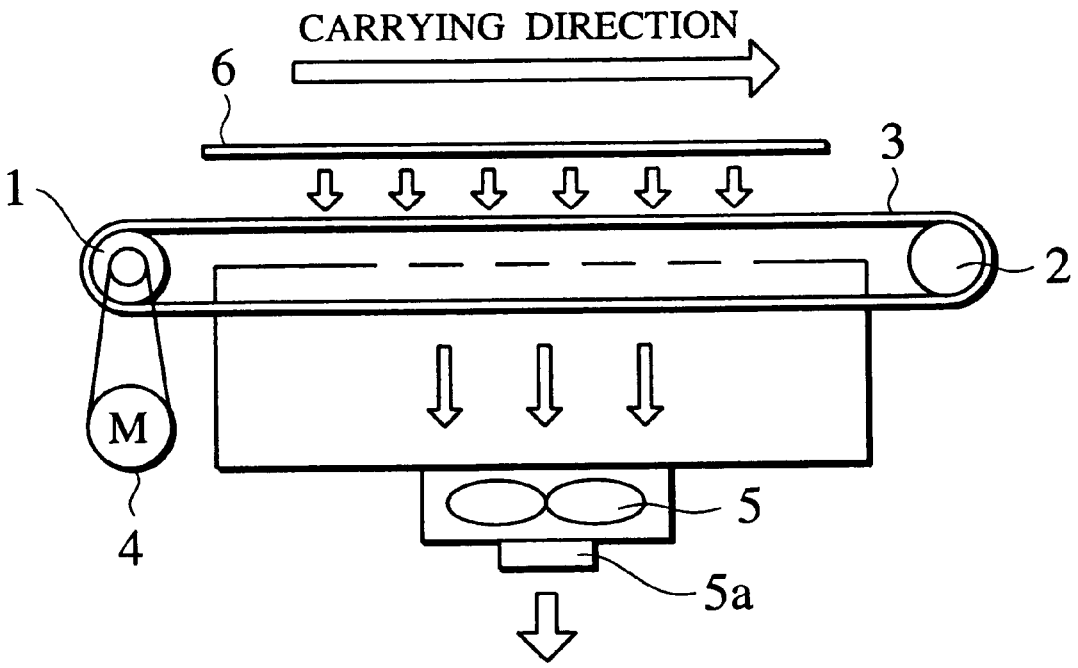
FIG. 1 is an outline view of a paper carrying device in the prior art.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Figure 3:
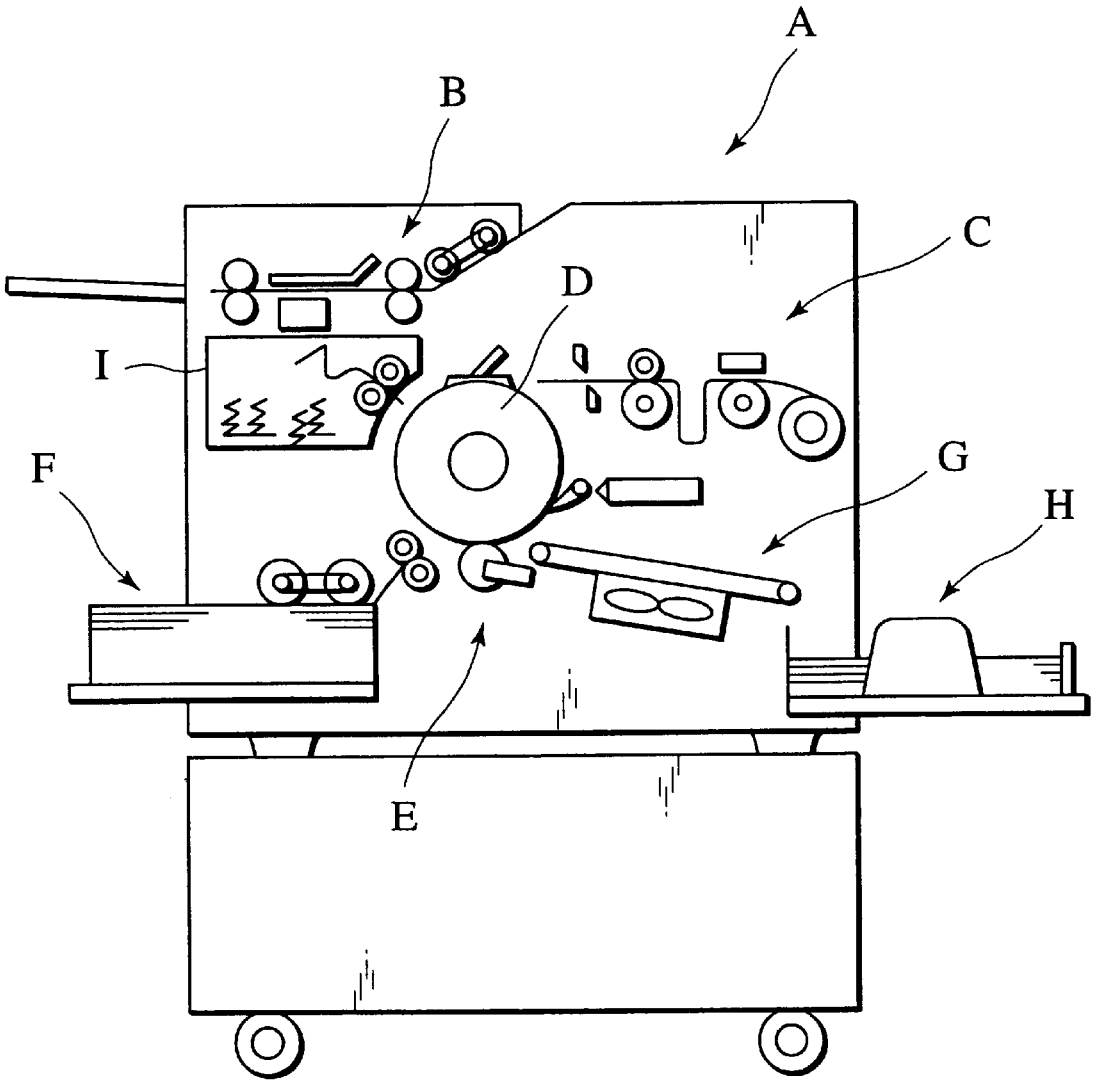
FIG. 3 is a general view illustrating the whole of a stencil printing machine.

As illustrated in FIG. 3, the stencil printing machine A is mainly composed of an original reading section B for reading an original as electrical signals; a stencil making section C for making perforations on a stencil sheet by thermal fusion on the basis of the image data read by the original reading section B; a printing section E for winding, on a printing drum D, the stencil made in the stencil making section C and transferring ink to supplied paper to print images on the paper; a paper feed section F for supplying the paper to the printing section E; a paper discharge section G for carrying the paper on which the images have been printed in the printing section E; a stacker section H on which pieces of the paper carried from the paper discharge section G are successively loaded; and a stencil discharge section I for discharging the stencil with which the images have been printed. In the paper discharge section G, a paper carrying device in a suction manner is used.

Figure 2A:
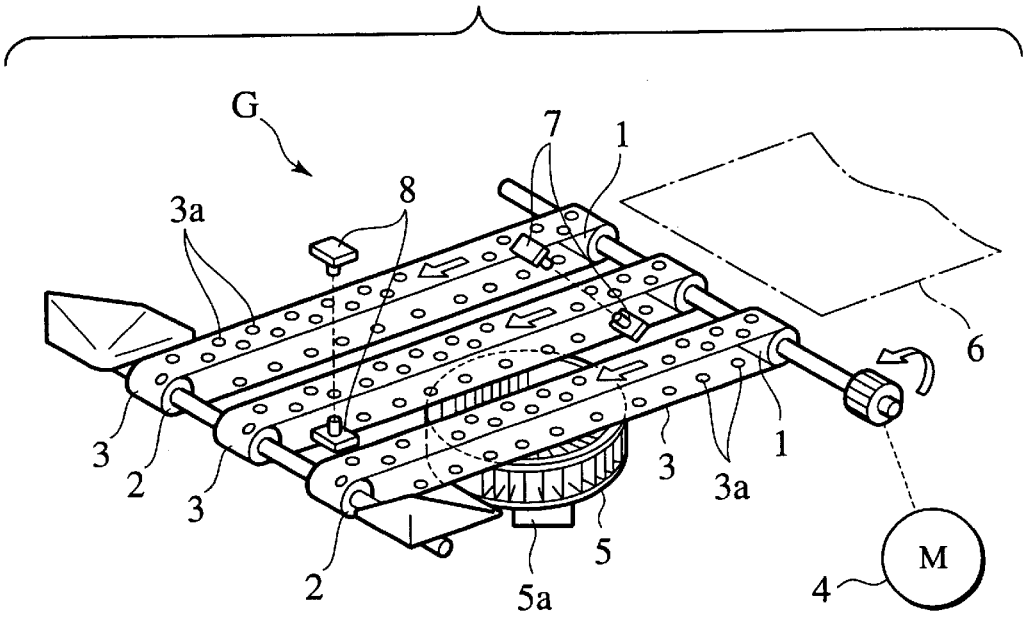
FIG. 2A is a perspective view of main portions of a paper carrying device according to a first embodiment of the present invention.
Figure 2B:
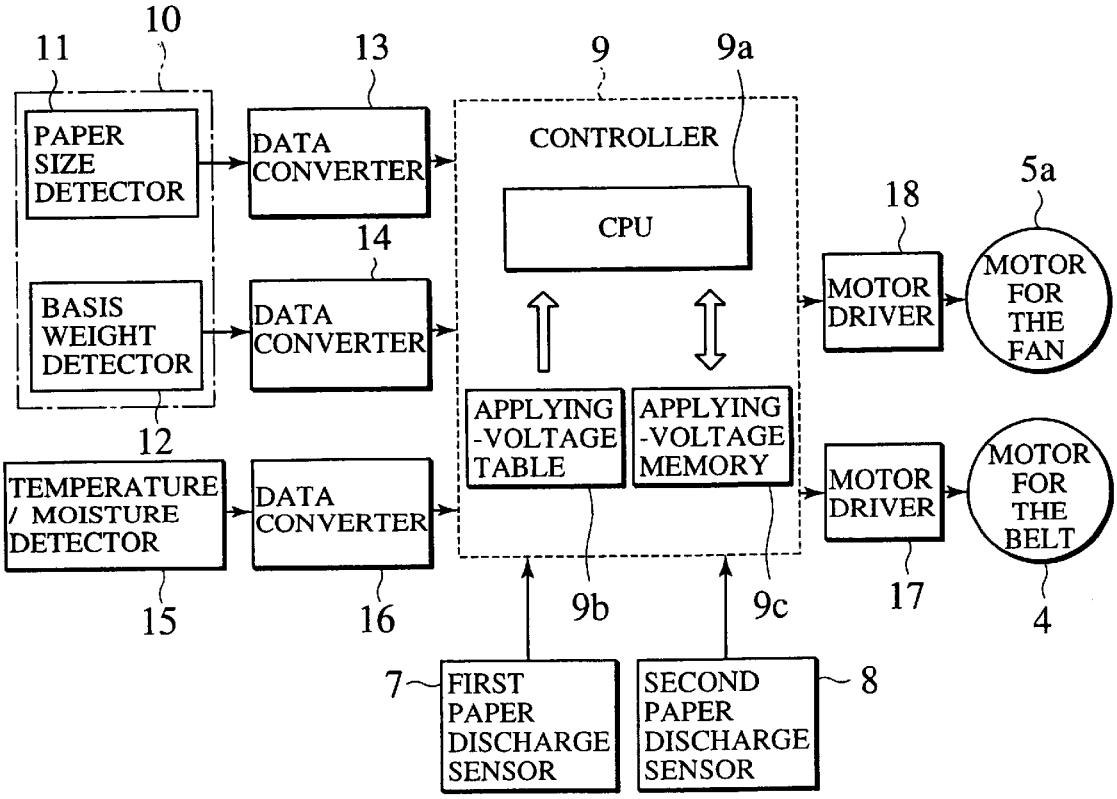
FIG. 2B is a block view of a circuit of this device.

As illustrated in FIGS. 2A,B, the paper carrying device is provided with pulleys 1 and 2 at a paper carrying start position and a paper carrying end position, respectively. Three endless carrying belts 3 are set up onto this pair of the pulleys 1 and 2 so as to stretch between the pulleys 1 and 2. One of the pulleys 1 and 2 is driven and rotated by a belt driving motor 4. By the rotating power of the belt driving motor 4, the carrying belts 3 are moved. A great number of air permeating holes 3*a* are made in the carrying belts 3. Through the air permeating holes 3*a*, air sent from a suction fan 5 acts effectively as sucking power on paper 6. The suction fan 5 is positioned below the carrying belts 3. This suction fan 3 is rotated and driven so as to suck air above the fan 3 by driving power of a motor 5*a* for the fan 3, which is a fan driving source. Above and below the carrying belts 3, a first paper discharge sensor 7 and a second paper discharge sensor 8 of a transmission type are respectively located at an interval from each other. Detection data in the respective sensors 7 and 8 are outputted to a controller 9. On the basis of the outputted detection data, the controller 9 judges whether or not the paper 6 is normally carried.

A paper data detector 10 is composed of a paper size detector 11 and a basis weight detector 12. The paper size detector 11 is a member for detecting the size of the paper 6 set in the paper feed section F. Specific examples of the member for detecting paper size include a member for detecting the size of the paper 6 set in the paper feed section F by the combination of outputs from plural reflection type sensors fitted into the paper feed section F; a member for detecting a shift volume of a paper feed fence, which is slid so as to fit to the side of the paper 6, by means of a volume-variable type device, an encoder-pulse type device, or a distance-measuring sensor (for example, a laser displacement sensor) or the like; and a member wherein such a shift volume is inputted through an operation panel. Detection data in the paper size detector 11 is outputted through a data converter 13 to the controller 9. The basis weight detector 12 is a member for detecting the basis weight of the paper 6 set in the paper feed section F. Specific examples of the member for detecting the basis weight of the paper 6 include a panel input type device and a pressure sensor. The detection data in the basis weight detector 12 is outputted through a data converter 14 to the controller 9.

A temperature/moisture detector 15 as a surrounding atmosphere detecting unit is a member for detecting the temperature and moisture of the atmosphere around the paper carrying device, and detection data in the detector 15 are outputted through the data converter 16 to the controller 9.

The controller 9 has a central processing unit 9*a*; an applying-voltage table 9*b*, whose data can be read by the central processing unit 9*a*, in which data for an applying-voltage table are stored; and an applying-voltage memory 9*c*, whose data can be read and recorded by the central processing unit 9*a*, in which a set applying-voltage value is memorized. As shown in FIG. 4, the applying-voltage table 9*b* has applying-voltage data using paper size and paper basis weight as parameters. Several of such applying-voltage data, depending on the relationship between temperature and moisture, are stored. The applying-voltage data are such data that the sucking power of the suction fan 5 to the paper 6 is set to become best for the size and the basis weight of the paper 6. The applying-voltage data can be obtained by advance experiments, calculations or the like.

For example, when the size of the paper 6 is large, the applying-voltage is set to a large value because of necessity for making the sucking power large. When the size of the paper 6 is small, the applying-voltage is set to a small value. This is because it is sufficient that the sucking power to be obtained is small. For the same reason, when the basis weight of the paper 6 is large, the applying-voltage is set to a small value. When the basis weight of the paper 6 is small, the applying-voltage is set to a large value because of necessity for making the sucking power large. When the moisture is high, the applying-voltage is set to a large value because of necessity for making the sucking power large. When the moisture is low, the applying-voltage is set to a small value. This is because it is sufficient that the sucking power to be obtained is small.

The controller 9 outputs control signals to respective motor drivers 17 and 18. On the basis of the respective control signals, the respective motor drivers 17 and 18 output driving signals to the belt driving motor 4 and the motor 5*a* for the fan. On the basis of the applying-voltage value in the applying-voltage memory 9*c*, the controller 9 controls the driving power of the motor 5*a* for the fan through the motor driver 18. The content of the control will be described in sentences stating the effect of the present paper carrying device.

Figure 5:
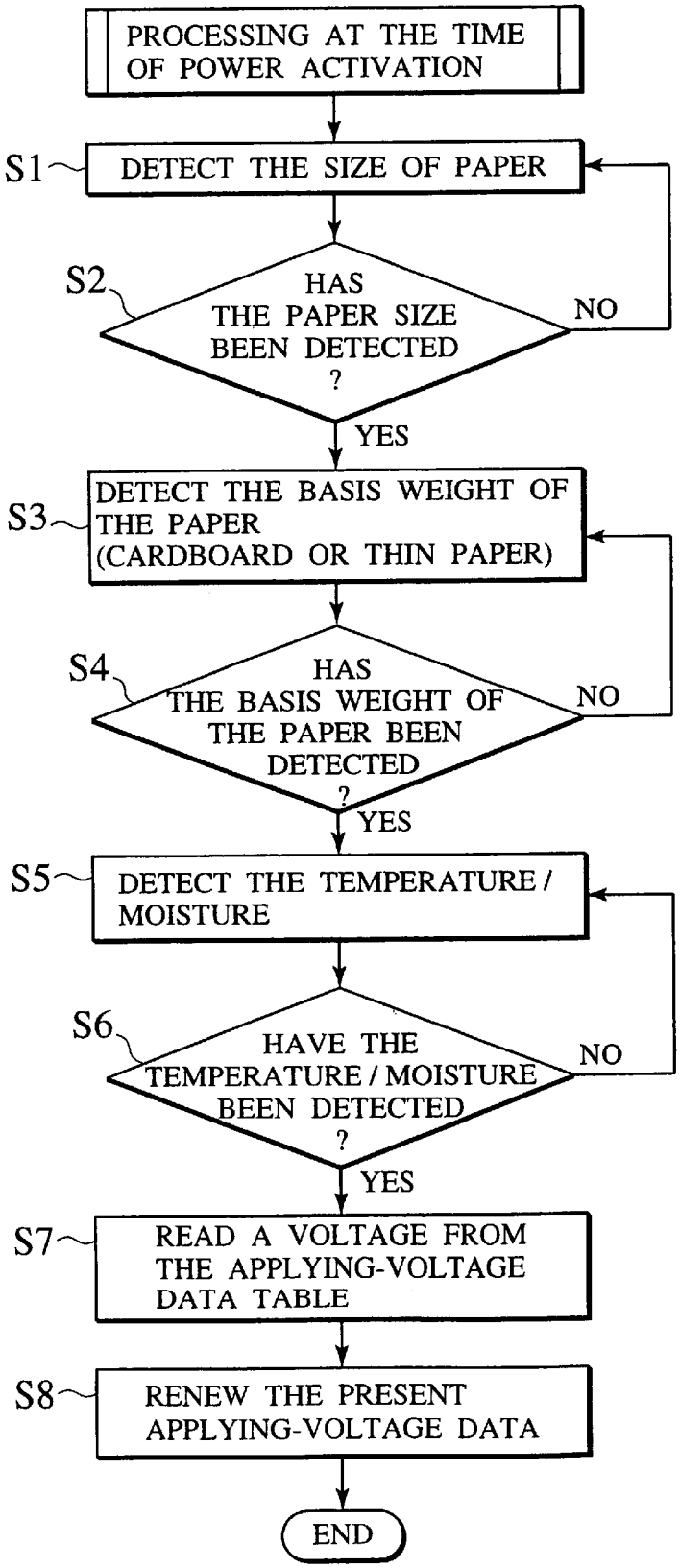
FIG. 5 is a flowchart at the time of power activation about the first embodiment of the present invention.

The following will describe the effect of the paper carrying device having the above-mentioned structure. As shown in FIG. 5, when the electrical power of the stencil printing machine is activated, the controller 9 takes in detection data from the paper size detector 11 to detect the size of the paper (steps Si and S2). When the paper size is detected, the controller 9 takes in detection data from the basis weight detector 12 to detect the basis weight of the paper (steps S3 and S4). When the paper basis weight is detected, the controller 9 takes in detection data from the temperature/moisture detector 15 to detect surrounding temperature and moisture (steps S5 and S6).

Next, the controller 9 reads applying-voltage data corresponding to the respective detection data from the applying-voltage table 9*b*, and then the content in the applying-voltage memory 9*c* is renewed to the read applying-voltage data (steps S7 and S9). Thus, the present process is ended.

Figure 6:
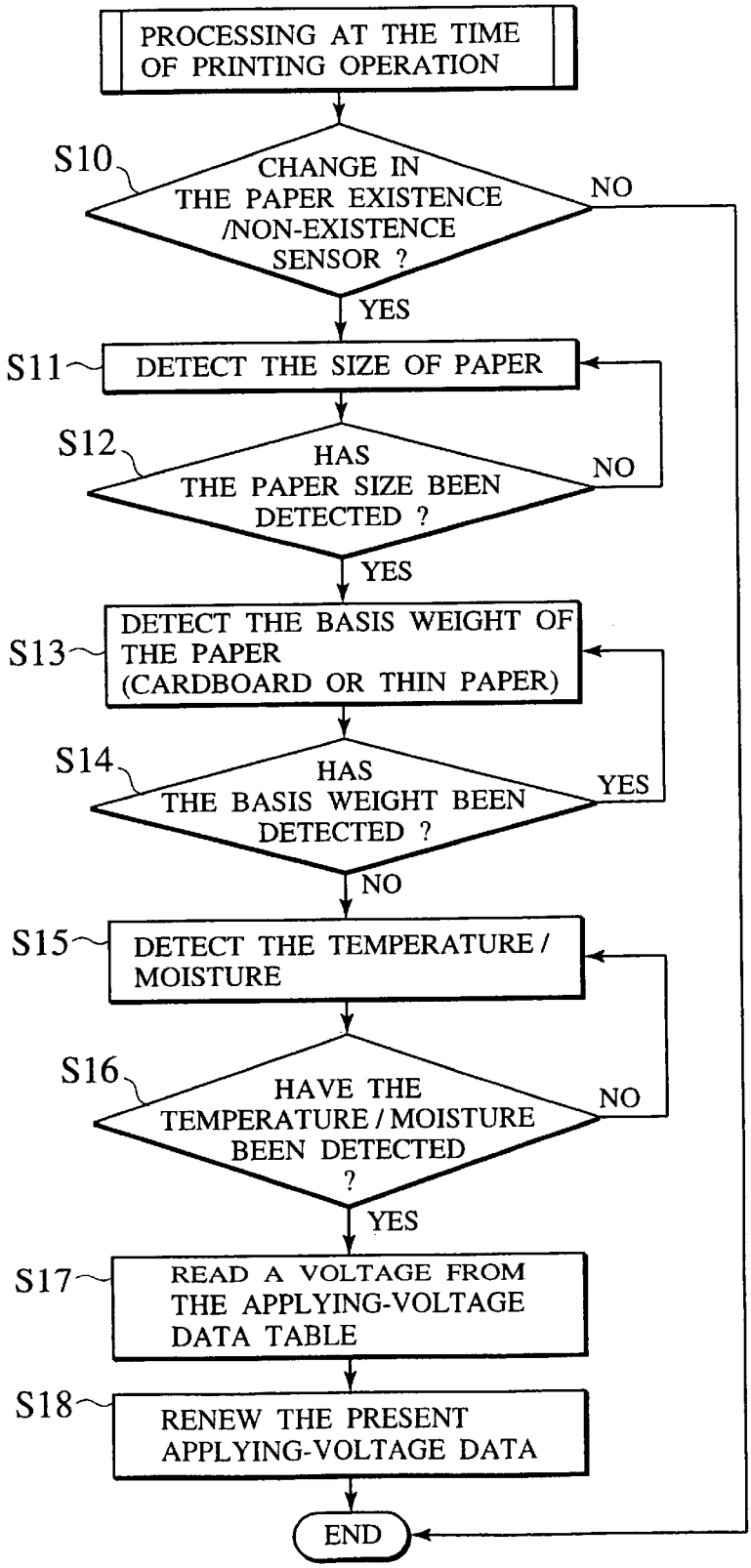
FIG. 6 is a flowchart at the time of printing operation about the first embodiment of the present invention.

As shown in FIG. 6, when the printing mode is started, it is detected whether or not a signal from a paper existence/non-existence sensor in the paper feeding section F changes (step S10). In the case of a change in the signal, the above-mentioned detection data taking-in steps and the above-mentioned applying-voltage data renewing steps are performed (steps Sll to S18). In the case of no change in the signal, the present process is ended without performing any step. That is, in the case that the paper 6 set in the paper feed section F may be new paper based on exchange, data on the paper 6 and the like are taken into prepare an appropriate applying-voltage data.

The belt driving motor 4 is driven. By this driving power, the carrying belt 3 is moved. The motor 5*a* for the fan 5 is driven. By this driving power, the suction fan 5 is rotated. When the paper 6 on which images have been printed on the printing section E is loaded from the paper carrying start position onto the carrying belt 3, the paper 6 is caused to adhere to the carrying belt 3 by sucking power of the suction fan 5. The paper 6 in this adhesive state is carried to the paper carrying end position by the movement of the carrying belt 3.

In the above-mentioned action steps, the sucking power is controlled depending on the sort (characteristics) of the carried paper 6 because the driving power of the motor 5*a* for the fan 5 is adjusted by the applying-voltage data. Therefore, appropriate sucking power constantly acts depending on the sort of the paper 6 or the like so that excessive electrical power is not consumed. Moreover, there does not arise a problem that excessive load is applied to the carrying belt 3 by excessive sucking power. Therefore, excessive electrical power is not consumed in the belt driving motor 4, either.

The first embodiment has the temperature/moisture detector 15 as a surrounding atmosphere detecting unit to make the driving power of the motor 5*a* for the fan 5 variable, additionally considering the temperature and the moisture of the atmosphere around the paper carrying device. For this reason, more appropriate sucking power can be caused to act so that power consumption can be more saved.

Figure 7:
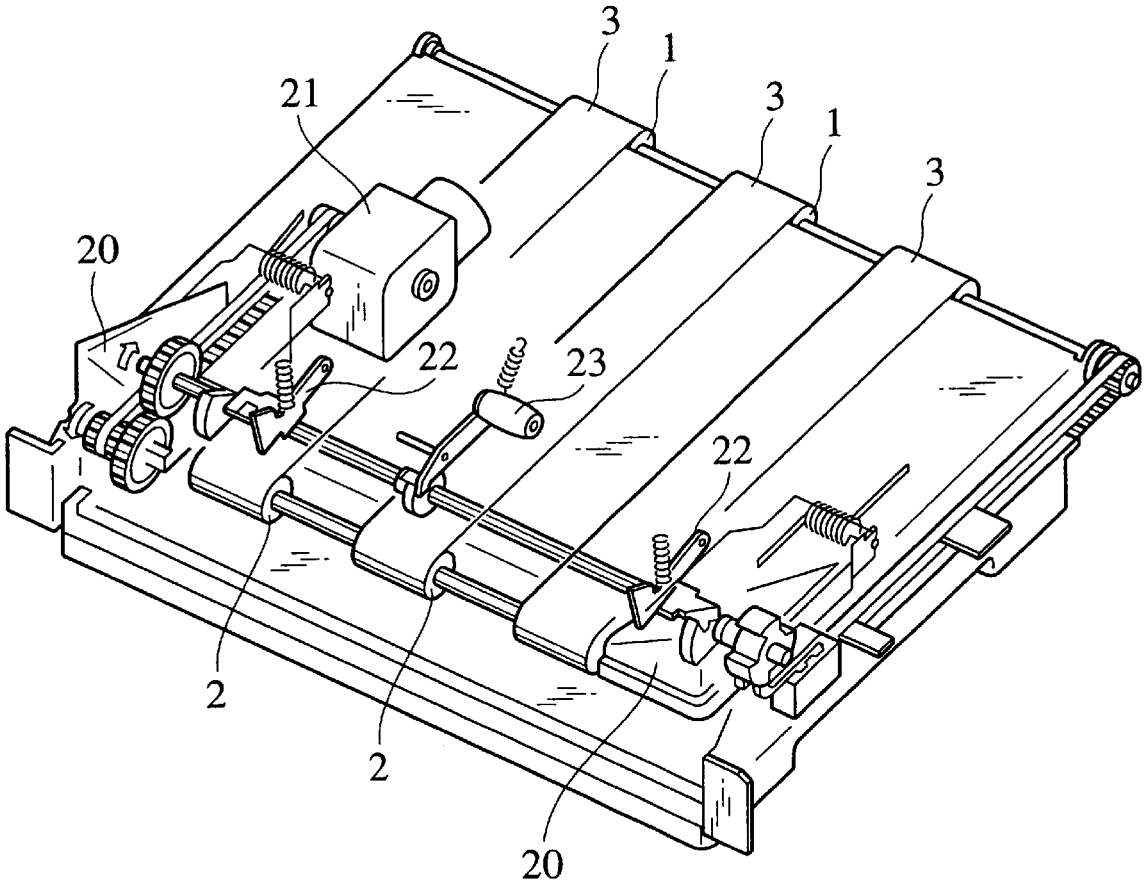
FIG. 7 is a perspective view of main portions of a paper carrying device according to a second embodiment of the present invention.

FIGS. 7 and 8 illustrate a second embodiment of the present invention. The second embodiment is also an embodiment wherein a paper carrying device of the present invention is applied to a paper discharge section of a stencil printing device.

In the second embodiment shown in FIGS. 7 and 8, the same symbols as in the first embodiment are attached to the same elements as in the first embodiment and the explanation of such elements will be omitted in order to avoid overlap of description. Only different elements will be described.

That is, a pair of paper discharge wings 20 is located at both side ends of the three carrying belts 3. This pair of the paper discharge wings 20 is made to move it upwards and downwards by driving power of a motor 21 for the wings. A pair of side flaps 22 is arranged inside this pair of the paper discharge wings 20. This pair of the side flaps 22 is also made to move upwards and downwards, independently from the pair of the wings 20, by driving power of the motor 21 for the wings. A belt roller 23 is disposed at the center of the pair of the wings 20. This belt roller 23 is also made to move upwards and downwards by driving power of the motor 21 for the wings.

Figure 8A:
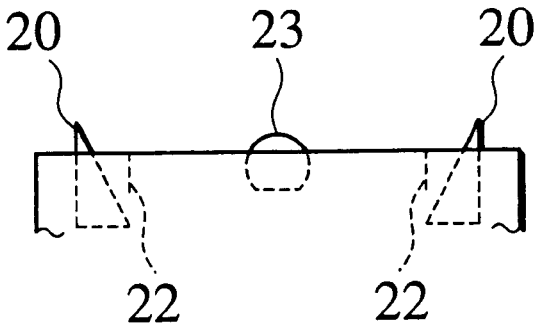
FIGS. 8A,8B,8C are schematic views of respective wing states in the second embodiment of the present invention.
Figure 8B:
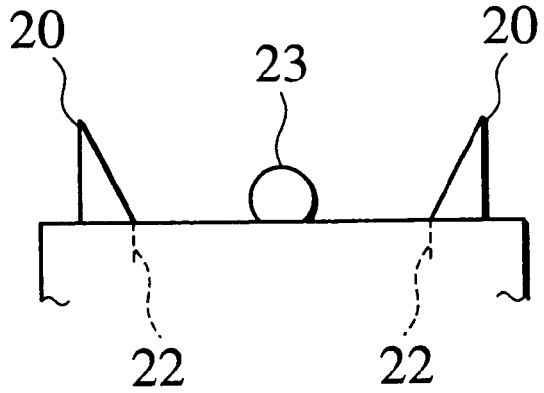
Figure 8C:
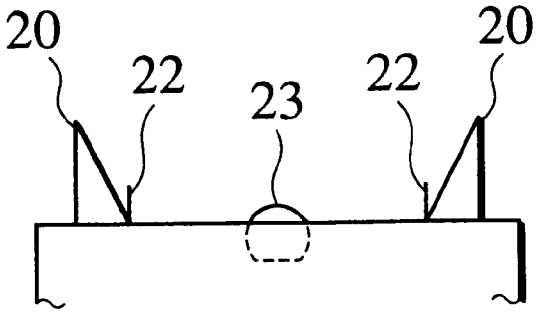

The pair of the paper discharge wings 20, the pair of the side flaps 22, and the belt roller 23 are set into respective wing states shown in FIGS. 8A,8B,8C by set values of a non-illustrated paper width detector and a non-illustrated paper feed pressure switch. FIG. 8A shows the state of a position 1, in which the pair of the paper discharge wings 20, the pair of the side flaps 22, and the belt roller 23 are positioned at lower positions. FIG. 8B shows the state of a position 2, in which the pair of the paper discharge wings 20 and the belt roller 23 are positioned at upper positions, and the pair of the side flaps 22 is positioned at a lower position. FIG. 8C shows the state of a position 3, in which the pair of the paper discharge wings 20 and the pair of the side flaps 22 are positioned at upper positions, and the belt roller 23 is positioned at a lower position.

The second embodiment is made so as to have a non-illustrated carrying condition detector for detecting the set state of the wings and make driving power of a non-illustrated motor for the fan variable by means of a non-illustrated controller, under additional consideration of carrying conditions which the non-illustrated carrying condition detector detects. That is, in the second embodiment, the controller make the driving power of the non-illustrated motor for the fan variable, basically considering the characteristics of the paper, and additionally considering the surrounding temperature and moisture as well as the set wing state.

According to the second embodiment, the same effects and advantages as according to the first embodiment can be obtained. Besides, the driving power of the nonillustrated motor for the fan is adjusted under additional consideration of the set wing state, so that more appropriate sucking power can be caused to act. Thus, power consumption can be still more saved.

In each of the above-mentioned embodiments, the paper data detector 10 is composed of the paper size detector 11 and the basis weight detector 12 but may be composed to detect characteristics of the paper 6 by other data together with such data as above, or by data other than such data as above.

In each of the above-mentioned embodiments, the surrounding atmosphere detector for detecting data on the surrounding atmosphere is composed of the temperature/moisture detector 15 but may be composed to detect data on the surrounding atmosphere by other data together with such data as above, or by data other than such data as above.

In the above-mentioned second embodiment, the carrying condition detector is a member for detecting the state of the wings but may be composed to detect the carrying conditions by other data together with such data as above, or by data other than such data as above.

In the each of the embodiments, a paper carrying device of the present invention is applied to a paper discharge section of a stencil printing machine but may be, of course, applied to other than the paper discharge section of the stencil printing machine.

OTHER EMBODIMENTS

Various modifications will become possible for those skilled in the art after receiving the teachings of the present disclosure without depending from the scope thereof. For example, although paper is given for the sheet in the above-mentioned embodiments, it can be appreciated that other sheet such as the film used for overhead projector also falls within the scope of the invention.

Thus, while the present invention has been described in terms of a preferred embodiments, it will be appreciated by one of ordinary skill that the spirit and scope of the invention is not limited to those embodiments, but extend to the various modifications and equivalents as defined in the appended claims.

What is claimed is:

1. A sheet carrying device comprising a carrying belt which is disposed in a sheet discharge section of an image forming machine and can move by driving power, a suction fan located below the carrying belt, and a fan driving source which supplies rotating power to the suction fan, wherein a sheet on the carrying belt being caused to adhere to the carrying belt by sucking power of the suction fan and carried, further comprising:

a sheet data detecting unit for detecting data on the carried sheet, and a controlling unit for controlling driving power of the fan driving source to make the sheet sucking power appropriate on the basis of the data on the carried sheet detected by means of the sheet data detecting unit.

2. The sheet carrying device according to claim 1, further comprising:

a surrounding atmosphere data detecting unit for detecting surrounding atmosphere data;

wherein the controlling unit controls the driving power of the fan driving source under additional consideration of the surrounding atmosphere data detected by means of the surrounding atmosphere data detecting unit.

3. The sheet carrying device according to claim 1, further comprising:

a carrying condition detecting unit for detecting carrying conditions of the carrying belt;

wherein the controlling unit controls the driving power of the fan driving source under additional consideration of the carrying conditions detected by means of the carrying condition detecting unit.

4. The sheet carrying device according to claim 2, further comprising:

a carrying condition detecting unit for detecting carrying conditions of the carrying belt;

wherein the controlling unit controls the driving power of the fan driving source under additional consideration of the carrying conditions detected by means of the carrying condition detecting unit.

5. The sheet carrying device according to claim 1, wherein the sheet data detecting unit is composed of a sheet size detecting unit and a basis weight detecting unit.

6. The sheet carrying device according to claim 2, wherein the sheet data detecting unit is composed of a sheet size detecting unit and a basis weight detecting unit.

7. The sheet carrying device according to claim 3, wherein the sheet data detecting unit is composed of a sheet size detecting unit and a basis weight detecting unit.

8. The sheet carrying device according to claim 4, wherein the sheet data detecting unit is composed of a sheet size detecting unit and a sheet weight basis detecting unit.

9. The sheet carrying device according to claim 2, wherein the surrounding atmosphere detecting unit is a temperature/moisture detecting unit.

10. The sheet carrying device according to claim 3, wherein the carrying condition detecting unit detects the state of a wing which the device has.

11. The sheet carrying device according to claim 4, wherein the carrying condition detecting unit detects the state of a wing which the device has.

* * * * *